United States Patent [19]

Maroszek

[11] Patent Number: 4,594,492

[45] Date of Patent: Jun. 10, 1986

[54] MICROWAVE PACKAGE INCLUDING A RESILIENTLY BIASED BROWNING LAYER

[75] Inventor: Raymond V. Maroszek, Neenah, Wis.

[73] Assignee: James River Corporation, Norwalk, Conn.

[21] Appl. No.: 617,527

[22] Filed: Jun. 4, 1984

[51] Int. Cl.[4] ..... H05B 6/80

[52] U.S. Cl. ..... 219/10.55 E; 219/10.55 F; 126/390; 426/243; 426/113; 99/DIG. 14; 206/591

[58] Field of Search ..... 219/10.55 E, 10.55 F, 219/10.55 M, 10.55 R; 126/390; 426/107, 110, 113, 241, 234, 243; 99/451, DIG. 14; 206/591, 593, 594; 220/450, 458, 468

[56] References Cited

U.S. PATENT DOCUMENTS

| | | | |
|---|---|---|---|
| 2,582,174 | 1/1952 | Spencer | 219/10.55 E |
| 3,591,751 | 7/1971 | Goltsos | 219/10.55 E |
| 3,865,301 | 2/1975 | Pothier et al. | 426/107 X |
| 3,934,106 | 1/1976 | MacMaster et al. | 219/10.55 F X |
| 3,941,967 | 3/1976 | Sumi et al. | 219/10.55 E |
| 4,190,757 | 2/1980 | Turpin et al. | 219/10.55 E |
| 4,230,924 | 10/1980 | Brastad et al. | 426/107 X |
| 4,267,420 | 5/1981 | Brastad | 219/10.55 F |
| 4,351,997 | 9/1982 | Mattisson et al. | 219/10.55 F |
| 4,357,513 | 11/1982 | Kawata et al. | 219/10.55 E X |
| 4,411,373 | 10/1983 | Kupersmit | 206/591 X |

*Primary Examiner*—Philip H. Leung

*Attorney, Agent, or Firm*—Sixbey, Friedman & Leedom

[57] ABSTRACT

A package (10) which is used to prepackage, store, ship and heat food products (11) is suitable for use in a microwave oven. The assembly includes a carton (12), a pair of microwave interactive layers (98) for converting microwave energy to heat and a paperboard spring formed from a blank (84) which includes wing sections (92,94) for resiliently biasing the pair of interactive layers into contact with opposed surfaces of a food product within the package to evenly brown and crisp the product. A microwave shield (22) may be incorporated in the package (20) to prevent microwaves from entering the package sidewalls.

16 Claims, 8 Drawing Figures

MICROWAVE PACKAGE INCLUDING A RESILIENTLY BIASED BROWNING LAYER

TECHNICAL FIELD

This invention relates generally to microwave food packages and more particularly to a food package which will produce microwave browning of food contained therein.

BACKGROUND ART

Although microwave cooking has experienced substantial growth, many consumers find that foods heated or cooked in a microwave oven do not possess the taste, sight and general appeal that they have come to associate with foods cooked in conventional ovens. A common complaint of consumers is that food cooked by microwave energy lacks the desired degree of browning or crispness. Various attempts have been made to provide microwave cook-in food packages which are adapted to compensate for the inherent lack of food browning associated with microwave cooking but none of these attempts have provided an entirely satisfactory package which is disposable and usable for shipping, selling, storing and serving of the packaged food.

A first approach, as represented by Brastad in U.S. Pat. No. 4,267,420 and Brastad et al in U.S. Pat. No. 4,230,924 uses flexible sheets of microwave interactive materials wrapped closely about individual items of food wherein the interactive material converts at least a portion of the impinging microwave energy into heat for browning the food surface. While flexible dielectric wrapping materials are suitable for foods such as fish sticks, onion rings and various forms of potatoes, fluids such as grease or vapor driven out of a food during heating may create leakage and/or venting problems, especially if the foods are breakfast sausages, or the like which may generate large quantities of such substances during heating. Still further, flexible wrapping is not suitable as a shipping and display container and will, therefore, require an additional outer carton.

A second approach, as represented by Turpin et al in U.S. Pat. No. 4,190,757, uses microwavable packages which do not require the product to be closely wrapped but includes a microwave interactive layer supported on or adjacent one inside container wall for browning the food. A second microwave interactive layer or heating element can be attached to another container wall to brown another surface of the food being heated such as illustrated in FIGS. 3 and 6 of the Turpin et al patent. However, the amount of heat transferred between the interactive layers of these packages and the food being browned may vary over the surface area of the foods due to surface of dimensional irregularities of the food and non-uniform size variation of the food during heating. Substantial variations or impairment of in the browning effect may, thus, occur over the area of the food being heated in these devices.

U.S. Pat. No. 3,591,751 to Goltsos discloses in FIG. 3 a microwave cooking implement including means contacting both the top and bottom surfaces of an article of food for converting microwave energy into heat for browning the food. The upper browning means includes plural metal rods which appear to be gravity biased into contact with the food but there is no suggestion of how such a bulky implement could be incorporated into an outer carton. Goltsos also fails to disclose an implement which is light enough, inexpensive enough and small enough to be incorporated into a food package.

Presently known design approaches have not provided a microwave "cook-in" disposable package for uniformly and conveniently browning or crisping foods which shrink and/or generate fluids during microwave heating. In particular, no such package design has been disclosed wherein the package is inexpensive and convenient to manufacture and wherein the package may be used as a shipping, display and serving implement.

DISCLOSURE OF THE INVENTION

It is an object of the present invention to provide a novel and improved disposable package for heating food in a microwave oven which does not have to be inverted during a heating process to evenly and uniformly brown top and bottom surfaces of the food being heated even if the food shrinks substantially.

It is a another object of the present invention to provide a novel and improved package for containing food to be heated using microwave energy wherein the package includes at least one microwave browning means for converting microwave energy into heat for browning a surface of food within the package, and wherein the browning means is resiliently biased into continuous contact with the food during the heating process.

It is another specific object of the present invention to provide a resilient paperboard spring for use in a package to urge a microwave browning means into engagement with a food product wherein the spring includes a support layer formed of inherently resilient and flexible paper material containing two foldlines dividing the support layer into a central section and two wing sections. The central section is generally planar when unbiased and the foldlines are shaped in a manner to cause the central section to be flexed into a non-planar configuration when the wing sections are folded out of the plane of the central section to cause the wing sections to be biased back toward the plane defined by the central section.

The above and other objects and advantages of the invention are achieved by a microwave, cook-in-disposable package including an outer carton formed from a one-piece microwave transparent paperboard blank cut, scored and folded to form an open topped tray with a hinged cover and further including a pair of opposed microwave interactive layers adapted to sandwich food located within the carton. At least one of the microwave interactive layers is urged by a biasing means towards the other layer to continuously and forcefully press one of the microwave interactive layers into contact with the food and to urge the food into contact with the other microwave interactive layer so that opposed surfaces of the food will be uniformly browned. The biasing means includes a paperboard spring as described above to which one of the microwave interactive layers may be laminated. A microwave shielding means may be associated with the package for controlling the proportion of microwave energy which reaches the food within the interior food cavity by blocking predetermined paths of entry of microwaves into the package. The microwave shielding means may include a strip of microwave impervious material such as metal foil laminated to a paper layer folded into a ring in surrounding relationship with the food contained within the package. To enhance the browning effect of the first and second microwave interactive layers, dextrose may be added to the food.

BEST MODE FOR CARRYING OUT THE INVENTION

Figure 1:
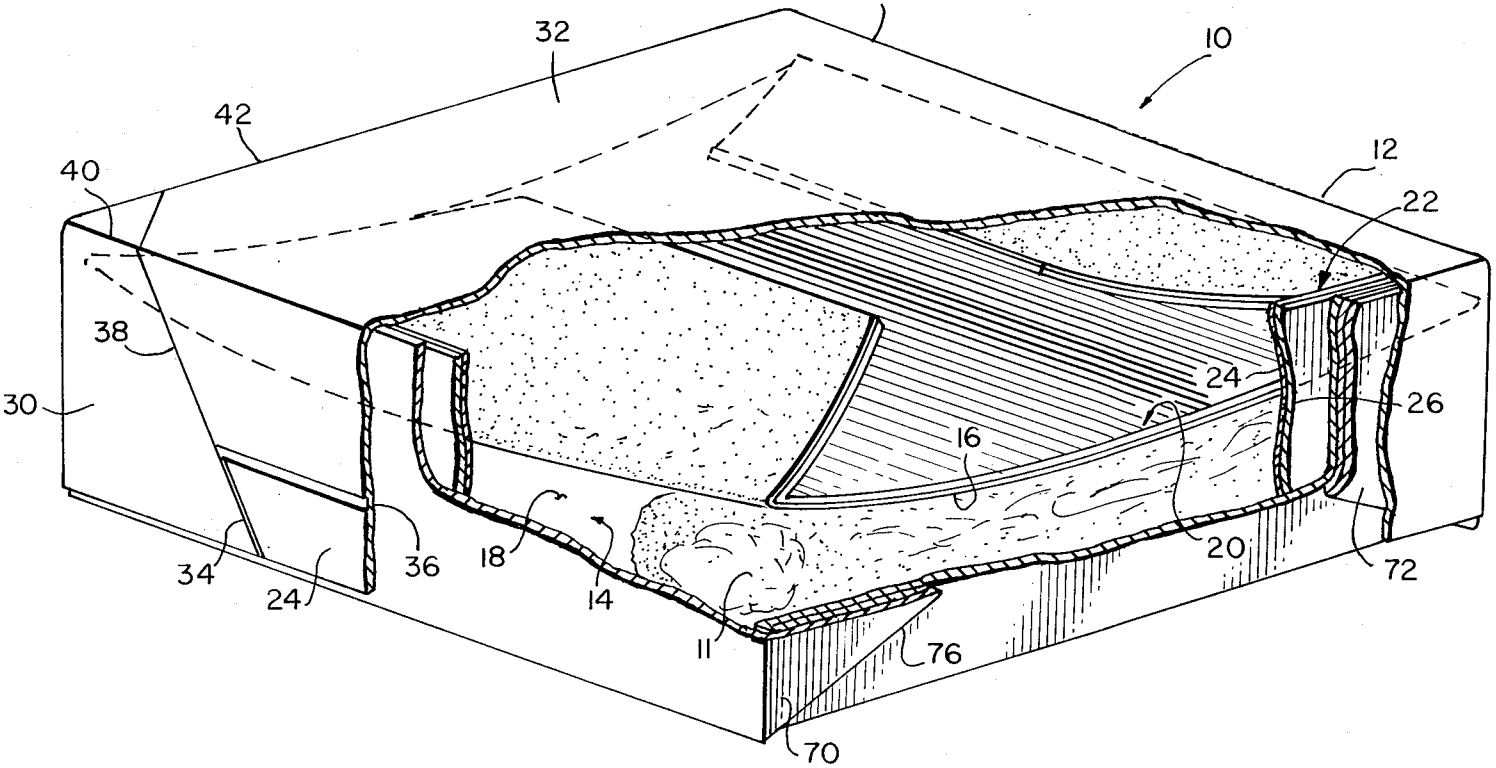
FIG. 1 is a partially cut-away perspective of a package embodying the present invention including an outer carton, a paperboard spring and a microwave shielding means.

Shown in FIG. 1 is a package 10 designed in accordance with the subject invention and suitable for heating food products in a microwave oven and for browning and crisping the food as though it were cooked in a conventional oven. Package 10 is particularly well adapted for food, such as sausage 11, which shrinks substantially during heating. Only a single sausage link is illustrated in FIG. 1 although a plurality of such sausages or a sausage patty of larger size could be accommodated in package 10. Referring specifically to FIG. 1, package 10 includes an outer carton 12 containing an interior food cavity 14 within which a pair of browning means 16 and 18 are positioned above and below the sausage 11 for converting microwave energy into heat for browning upper and lower surfaces of the sausage 11. A biasing means 20, located above browning means 16, operates to urge the first browning means 16 against the surface of the food within the interior food cavity 14 to resiliently and forcefully maintain uniform and continuous contact between the browning means 16 and 18 and the sausage to uniformly brown the food even if the food surfaces change in shape, dimension or composition during heating. In fact, a substantial change in shape or dimension can be accommodated by the food package 10. The biasing means 20 permits uniform browning without requiring the food product or the package 10 to be inverted during cooking and without relying solely on gravity to maintain contact between the heating means and the foods surfaces.

As will be explained more fully below, each browning means includes an interactive layer of material capable of converting into heat at least a portion of the microwave energy impinging on the interactive layer. The interactive layer of browning means 18 is supported on the bottom wall of carton 10 while the interactive layer of browning means 16 may be laminated to the lower side of a paperboard blank which has been cut, scored and folded into a winged configuration to form the biasing means 20 as will be described in greater detail below.

Adjacent the inside of the sidewalls of carton 10 and surrounding the food cavity 14 is a microwave shielding means 22 extending generally between the upper and lower browning means 16 and 18 for controlling the proportion of microwave energy which reaches the food within the interior food cavity 14. Shielding means 22 operates by blocking the paths of entry through the sidewalls of carton 10 thereby forcing a greater proportion of the available microwave energy to impinge on browning means 16 and 18. Although only partially illustrated in FIG. 1, microwave shielding means 22 includes a strip of microwave impervious material 24, such as a sufficiently thick layer of aluminum foil, laminated to a paper backing layer 26. Shielding means 22 will also be described in more detail below.

After package 10 has been subjected to the requisite amount of microwave energy to effect the desired cooking and browning of the sausage contained therein, it may be easily opened by lifting a small finger tab 28 found in the front sealing panel 30 which is integrally connected with the top wall 32 of the outer carton 12. Tab 28 is defined by two cut scores 34 (only one illustrated in FIG. 1) at each side and by a horizontal foldline 36 extending between the upper ends of each cut score 34. A partially cut-through score line 38 (only one of which is illustrated in Fig. 1) extends upwardly from each cut score 34 to the top edge 40 of front sealing panel 30 and across the top wall 32 to the corresponding lateral side edge 42 of the top wall 32 and from there along the lateral side edge 42 to the hinge foldline 44 between the top wall 32 and the rear side wall (not illustrated) of the carton 10. A pattern of adhesive may be used to seal front sealing panel 30 to the adjacent upstanding sidewall of carton 10 except for tab 28 which is left free for easy grasping by the user when opening the package. In particular, the user merely pivots tab 28 along its foldline 36 and pulls outwardly and upwardly to cause separation of that portion of the front sealing panel 30 and top wall 32 which lies between score lines 38.

A better understanding of the construction and operation of the package 10 can now be obtained by reference to FIGS. 2–5 which disclose the shape of the blanks from which the package components are formed. In particular, FIG. 2 discloses the outline of a carton blank 46 as viewed from the side of the blank which will become the interior of carton 10. Blank 46 is formed of microwave transparent paperboard which has been crush scored to form a first set of parallel foldlines 48, 50, 52 and 54 and to form a second set of parallel foldlines 56 and 58 which are perpendicular to the first set. The first and second sets of foldlines define the top wall 32 and bottom wall 60 and also define a pair of opposed lateral sidewalls 62 and 64 connected with bottom wall 60 by foldlines 56 and 58, respectively, and a second pair of opposed sidewalls including front sidewall 66 and back sidewall 60 connected with bottom wall 60 by foldlines 48 and 50, respectively. Side walls 62, 64, 66 and 68 are joined at their lateral edges by four corner webs 70, 72, 74 and 76 which are, in turn, bisected by four diagonal foldlines 77 which allow each corner web to be folded into a position adjacent a corresponding side wall as the sidewalls are moved into a perpendicular orientation with respect to the bottom wall 60. Reference is made to FIG. 1 wherein corner webs 70 and 72 are illustrated in their folded condition. This arrangement permits walls 60, 62, 64 and 68 to be folded into an open topped tray configuration having no corner holes through which liquids could leak from the carton. The resulting tray can be rendered liquid tight if the paperboard of which blank 46 is formed is either treated or coated to be liquid impervious. The remainder of blank 46 forms a hinged cover for the open topped tray and consists of top wall 32, a pair of lateral sealing panels 78 and 80 and front sealing panel 30. In addition to the cut scores 34, foldline 36 and partially cut-through score lines 38 described above, FIG. 2 discloses a pair of partial cut through score lines 82 formed on the inside of top wall 32 and front sealing panel 30. Score lines 82 are spaced laterally inwardly but parallel to partially cut through score lines 38 formed on the outside of top panels 32 and front sealing flap 30. The corresponding partially cut-through score lines cooperate during package opening to cause ply separation in the paperboard between the corresponding score lines located at each lateral side of top wall 32.

Laminated to or placed on the inside surface of bottom wall 60 is a microwave interactive layer 83 which may take the form of a metallized layer of polyester film on a paper backing. In particular, the metallized layer may be an extremely thin layer of aluminum which has been vapor deposited on the polyester film to a thickness of only a few microns. At this thickness, the aluminum layer interacts with microwaves by heating up to a temperature hot enough to brown and crisp food in contact therewith. The polyester film may also be adhered to a paper carrier layer which, in turn, may be adhered to the paperboard of blank 46. Although metallized polyester is preferred, any one of a large number of different types of microwave interactive materials may be used. Examples of other types of suitable interactive materials are disclosed in U.S. Pat. No. 4,190,757 to Turpin.

Figure 3:
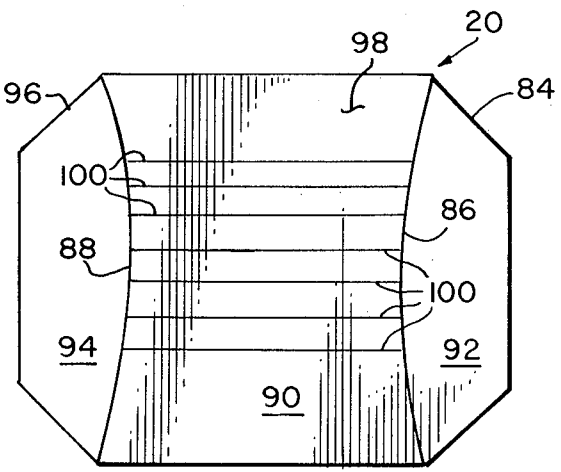
FIG. 3 is a schematic layout of a blank for forming the paperboard spring used in the package illustrated in FIG. 1.

Reference is now made to FIG. 3 wherein a blank 84 for forming the biasing means 20 is disclosed. In particular, blank 84 is formed of a paperboard support layer 96 such as an alkaline sized, bleached paperboard base stock having a basis weight of 200 lb./3000 square feet and a caliper of 16½ points available from POTLACH. Of course, other types of paperbord or microwave transparent material such as sheet plastic may be used so long as the material has a resiliency which tends to maintain the material in a planar condition and is capable of resisting the operating temperature of the interactive layer.

As further illustrated in FIG. 3, blank 84 includes a pair of crushed foldlines 86 and 88 oriented in generally parallel condition and extending between opposed sides of the blank to trisect the blank into three sections, including a central section 90 which is generally planar when unbiased and has a perimeter shape corresponding generally (although not exactly) to the inside horizontal cross sectional configuration of the interior food cavity 14 of carton 12. The preferred horizontal cross sectional configuration of interior food cavity 14 is square or rectangular. Foldlines 86 and 88 further define a pair of wing sections 92 and 94 connected to opposed sides of the central section 90. Foldlines 86 and 88 are configured in a manner to cause central section 90 to be flexed into a non-planar configuration as the wing sections are folded inwardly, thereby to cause the wing sections to be biased back toward the plane defined by the central section 90. As illustrated in FIG. 3, foldlines 86 and 88 may take the form of two smooth arcuate curves which are bowed inwardly toward the center portion of central section 90. Of course the radius of curvature of foldlines 86 and 88 may be adjusted to accommodate characteristics of the material forming the blank 84, the overall size of the package in which the blank is used and the degree of pressure required and the amount of shrinkage to be expected in the food which is heated in the package in which the blank 84 is designed to be used. The side of blank 84, which is designed to contact the food, may be laminated to browning means 16 (FIG. 1) as a convenient means for supporting the browning means and for insuring its proper assembly in the package 10. As described above with reference to the other browning means, a layer of microwave interactive material may be used to form browning means 16 and, in particular, a metallized layer of polyester film, of the same type preferred to above, is ideally suited for lamination to the paperboard support layer of blank 84.

Figure 4:
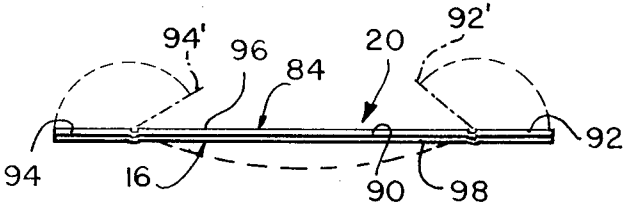
FIG. 4 is an elevational view of the spring blank of FIG. 3 taken in the direction of arrow IV in FIG. 3.
Figure 2:
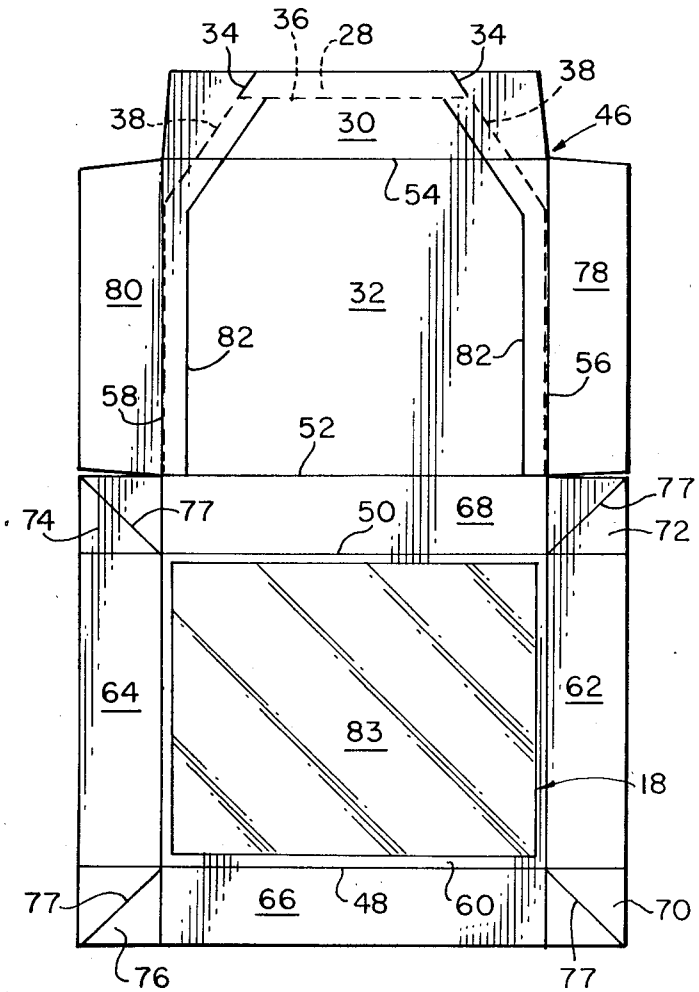
FIG. 2 is a schematic layout of a carton blank for forming the outer carton of the package illustrated in FIG. 1.

FIG. 4 is an edge view of blank 84 which more clearly illustrates the laminated nature of the biasing means 20 including paperboard support layer 96 and a metallized polyester layer 98 forming the browning means 16. FIG. 4 further illustrates the manner in which wings 92 and 94 are folded inwardly along foldlines 86 and 88, respectively, into an orientation shown by dashed lines 92' and 94' which is more than 90° out of the plane defined by central section 90 unbiased. As is best illustrated in FIG. 1, such inward folding of wing sections 92 and 94 causes the central section 90 to be flexed out of its normal planar condition which, in turn, causes wing sections 92 and 94 to be resiliently urged backwardly into the plane originally defined by central section 90. As further illustrated in FIG. 3, metallized polyester layer 98 may optionally be cut scored along parallel lines 100 extending transversely between foldlines 86 and 88. These cut score lines may be employed if lamination of the metallized layer is found to hinder the desired resilience of the support layer. It has also been found highly desirable to orient the grain of the paperboard support layer so that it extends transversely between foldlines 86 and 88 to augment the strength and resilience of the biasing means 20.

Figure 5:
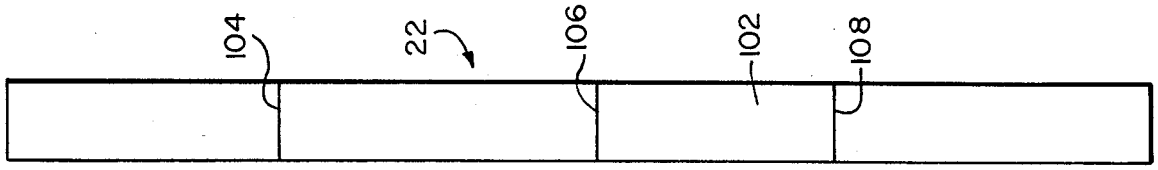
FIG. 5 is a schematic layout of a blank for forming the microwave shielding means used in the package illustrated in FIG. 1.

Reference is now made to FIG. 5 which discloses a blank 102 from which the microwave shielding means 22 may be formed. In particular, blank 102 is formed from a strip of paperboard material having a length corresponding to the sidewall perimeter of carton 10 and a height generally corresponding to the vertical height of the sidewalls of carton 10. Paperboard blank 102 includes three parallel crush scored foldlines 104, 106 and 108 which permits blank 102 to be folded into a generally ring shape such that the blank may be placed within the interior food cavity 14 adjacent the sidewalls of carton 10 in surrounding relationship with respect to the food placed therein.

Figure 6:
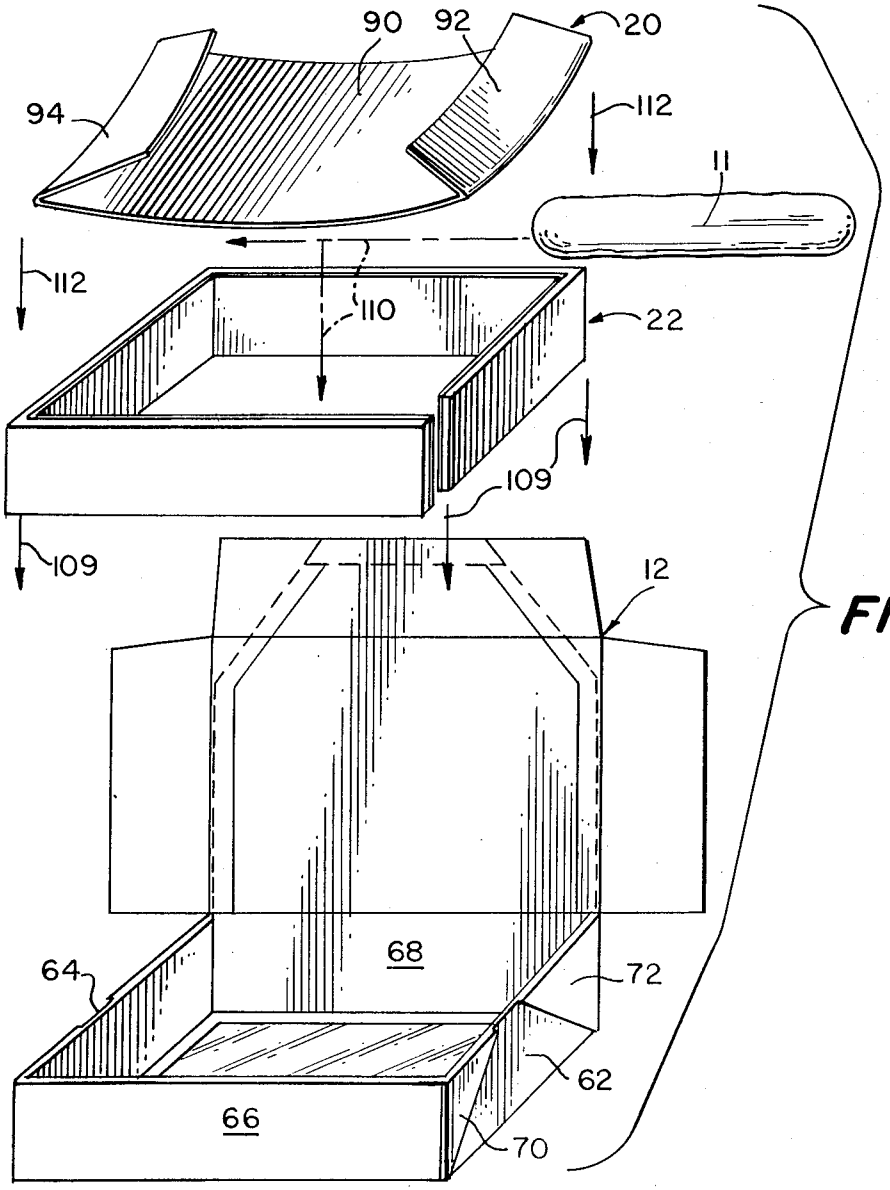
FIG. 6 is an exploded perspective view of the package illustrated in FIG. 1 wherein the paperboard spring has been rotated 90° from the position in FIG. 1 to illustrate a suitable alternative position for the spring.

Reference is now made to FIG. 6 wherein an exploded view of the package 10 of FIG. 1 is illustrated. In particular, carton 12 is shown in a configuration in which the sidewalls 62, 64, 66 and 68 have been folded into an upright orientation and the corner webs (only 70 and 72 are illustrated) have been folded into an adjacent orientation along corresponding lateral sidewalls 62 and 64. Top wall 32 remains in its open position. A microwave shielding means 22 has been folded in preparation for placement within the open topped tray portion of carton 12 by movement in the direction of arrows 109. Sausage link 11 is assembled with the package of FIG. 6 by movement in the direction illustrated by arrows 110. Finally, the biasing means 20 has been formed into a paperboard spring by folding the wing sections 92 and 94 of blank 84 as illustrated in FIG. 4 and the folded spring is moved into the open topped tray portion of carton 12 illustrated by arrows 112. FIG. 6 shows an alternative orientation of biasing means 20 from that illustrated in FIG. 1 by being rotated 90° from the orientation shown in FIG. 1.

Figure 7:
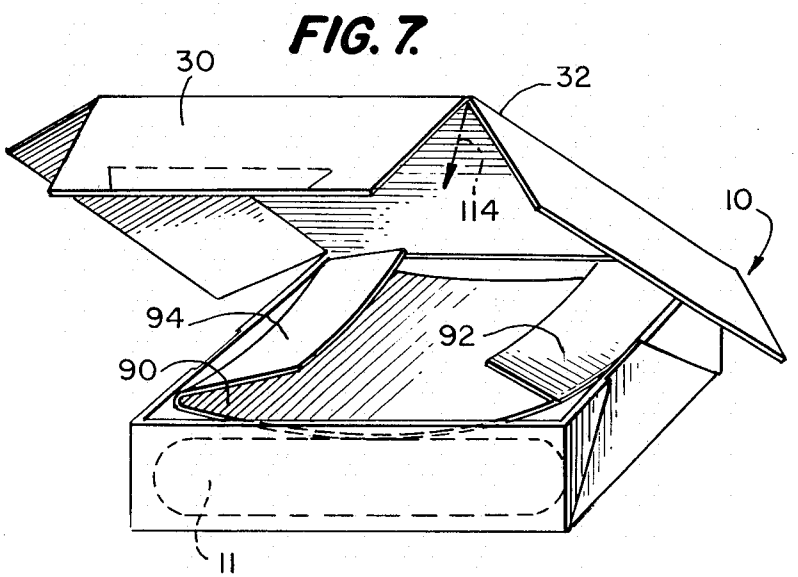
FIG. 7 is a perspective view of the package illustrated in FIG. 1 while in a partially assembled condition.

FIG. 7 illustrates a subsequent stage in the assembly of package 10 wherein the steps illustrated by the arrows of FIG. 6 have been carried out and the top wall is ready to be moved into its closed condition as illustrated by arrow 114 to cause wing sections 92 and 94 to be further rotated resulting in flexing of central section 90 by an additional amount sufficient to insure that the biasing means 20 maintains the first browning means 16 laminated therewith in forceful contact with a sausage 11 throughout the heating and browning process. For this to occur, the vertical height of the carton sidewalls must be chosen carefully in light of the vertical height of the food to be placed within the carton, the resilient characteristics of the biasing means 20 and the expected degree of shrinkage which the food is likely to undergo during the subsequent microwave heating process. Once top wall 32 is in its fully closed position, the front sealing panel 30 and the lateral sealing panels 78 and 80 may be sealed to corresponding sidewalls of the carton 10.

Figure 8:
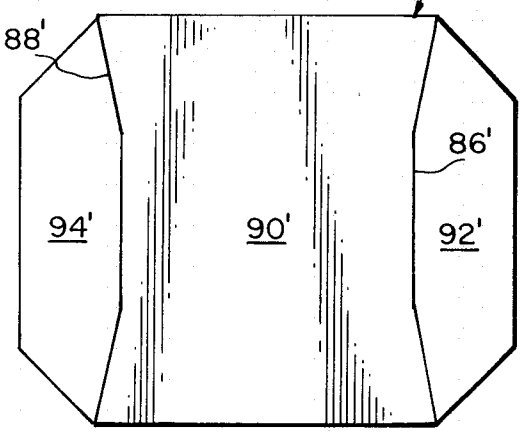
FIG. 8 is a schematic layout of an alternative blank for forming the paperboard spring used in the package illustrated in FIG. 1.

FIG. 8 merely illustrates an alternative embodiment 20' of the biasing means wherein the foldlines 86' and 88' defining the central section 90' and wing sections 92' and 94' are each formed by straight line segments approximating a curve. Again, the operation of the biasing means 20' would be the same as that described above with respect to the embodiment illustrated in FIG. 3. In particular, upon closing of the top wall of the carton, the wing sections will be forced toward the central section thereby creating a spring-like resistance which resiliently urges browning means 16 against the food contained in the package. The biasing means 20' permits the heating element to compensate for food shrinkage and to keep sufficient pressure on the food to insure proper browning and crisping of the upper surface of the food placed in the package without requiring the package to be inverted.

More desirable browning effects have been achieved by adding certain types of materials to the sausage product, such as dextrose. This material has been found to enhance the browning and carmelizing effect of the package.

INDUSTRIAL APPLICABILITY

This invention has particular utility in the packaging of food for distribution and sale in refrigerated and frozen display cases now common in most grocery stores. The disclosed package is ideally suited for packaging, shipping, vending and microwave heating of a variety of food products, but is especially useful in conjunction with products that shrink substantially during heating such as sausage.

I claim:

1. A package for use in heating and browning food by microwave energy comprising:

a carton containing an interior food cavity;

a first browning means associated with said carton for converting microwave energy into heat for browning a surface of the food located within the interior food cavity; and biasing means imposing a spring force on said first browning means to cause said first browning means to be urged positively into contact with the surface of the food within the interior food cavity and for maintaining said first browning means in forceful contact with the food and the food in forceful contact with an opposing surface in said interior food cavity of said carton during the microwave heating and browning.

2. The package defined in claim 1, further including a second browning means associated with said carton for converting microwave energy into heat for browning another surface of the food located within the interior food cavity, and wherein said biasing means urges said first browning means toward said second browning means.

3. The package defined in claim 1, further including microwave shielding means for controlling the proportion of microwave energy which reaches the food within the interior food cavity by blocking predetermined paths of entry of microwaves into the interior food cavity.

4. The package defined in claim 1, further includes an ingredient added to the food for enhancing a browning effect of said first browning means.

5. The package defined in claim 4, wherein said ingredient includes dextrose.

6. A package for use in heating and browning food by microwave energy comprising:

a carton containing an interior food cavity;

a first browning means associated with said carton for converting microwave energy into heat for browning a surface of the food located within the interior food cavity wherein said first browning means includes a first interactive layer formed of material capable of converting into heat at least a portion of the microwave energy impinging on said interactive layer; and biasing means for urging said first browning means against the surface of the food within the interior food cavity and for maintaining said browning means in forceful contact with the food during microwave heating and browning wherein said biasing means includes a support layer of resilient material laminated to said first interactive layer.

7. The package defined in claim 6, wherein said support layer includes (a) a central section which is generally planar when unbiased, said central section having a perimeter shape corresponding to the inside horizontal cross sectional configuration of the interior food cavity of said carton, and (b) a pair of wing sections connected to opposed sides of said central section along corresponding foldlines.

8. The package defined in claim 7, wherein the interior food cavity has a generally rectangular horizontal cross sectional configuration and wherein said foldlines are configured to cause said central section of said support layer to be flexed into a non-planar configuration as said wing sections are folded along said foldlines to cause said wing sections to be biased back toward the plane defined by said central section.

9. The package defined in claim 8, wherein each said foldline is a smooth arcuate curve.

10. The package defined in claim 8, wherein each said foldline is formed of a plurality of straight line segments approximating a curve.

11. The package defined in claim 8, wherein said resilient material includes paper material having a grain direction extending transversely of said foldlines.

12. The package defined in claim 8, wherein said carton is formed of a single, unitary blank formed of microwave transparent material, said carton including a rectangular bottom wall and two pairs of opposed sidewalls connected to corresponding edges of said bottom wall, said side walls having lateral edges interconnected by corner webs which may be folded into a collapsed configuration when said sidewalls are folded into a position perpendicular to the plane of said bottom wall to form an open topped tray, and wherein said blank further includes a top wall hingedly connected to one edge of one of said side walls for movement between an open position exposing the interior of said open topped tray and a closed position covering the top of said open topped tray and at least one closing panel means for holding said top wall in its closed position.

13. The package defined in claim 12, further including a second browning means for converting microwave energy into heat for browning another surface of the food locted within the interior food cavity, said second browning means including a second interactive layer laminated to said bottom wall of said unitary blank, said second interactive layer being formed of material capable of converting into heat at least a portion of the microwave energy impinging on said second interactive layer.

14. The package as defined in claim 13 for heating food of known precooked vertical height and known heat shrink characteristics, wherein said wing sections are folded toward the side of said central section opposite said first interactive layer, and wherein the vertical height of said side walls is selected to allow the food of known vertical height to be placed between and in contact with said first and second browning means when said top wall is in its open position and to cause said wing sections after being folded at least 90° out of the plane of said central section to be folded further upon movement of said top wall into its closed position thereby flexing said central section by an amount sufficient to insure that said biasing means maintains said first browning means in forceful contact with the food throughout the heating and browning process.

15. The package defined in claim 8, wherein said microwave shielding means includes a strip of microwave impervious material positioned within the interior food cavity adjacent said sidewalls and adopted to surround food placed within the interior food cavity.

16. The package defined in claim 15, wherein said microwave impervious material is a metal foil and wherein said microwave shielding means further includes a paper layer laminated to said metal foil.

* * * * *